US008276238B2

(12) United States Patent
Young

(10) Patent No.: US 8,276,238 B2
(45) Date of Patent: Oct. 2, 2012

(54) ROLLER COVER CLEANER

(76) Inventor: Norman Donald Young, Springville, UT (US)

( * ) Notice: Subject to any disclaimer, the term of this patent is extended or adjusted under 35 U.S.C. 154(b) by 0 days.

(21) Appl. No.: 13/345,660

(22) Filed: Jan. 6, 2012

(65) Prior Publication Data

US 2012/0174946 A1 Jul. 12, 2012

Related U.S. Application Data

(60) Provisional application No. 61/430,671, filed on Jan. 7, 2011.

(51) Int. Cl.
*A47L 13/02* (2006.01)

(52) U.S. Cl. ..... 15/236.03; 15/236.07

(58) Field of Classification Search ..... 15/236.03, 15/104.04, 236.07
See application file for complete search history.

(56) References Cited

U.S. PATENT DOCUMENTS

| | | | | |
|---|---|---|---|---|
| 209,957 | A | | 4/1878 | Castle |
| 601,898 | A | | 4/1898 | McDonough et al. |
| 602,592 | A | | 4/1898 | Widness |
| 745,882 | A | | 12/1903 | Miller et al. |
| 978,372 | A | | 12/1910 | Hayne et al. |
| 1,144,749 | A | | 6/1915 | Beck |
| 1,579,495 | A | | 4/1926 | Stroud |
| 1,594,792 | A | | 8/1926 | Mortimer |
| 1,758,011 | A | | 5/1930 | Reach |
| 2,011,497 | A | | 8/1935 | Miller |
| 2,023,343 | A | | 12/1935 | Soderberg et al. |
| 2,139,537 | A | | 12/1938 | Newton |
| 2,297,566 | A | | 9/1942 | Laux |
| 2,466,200 | A | | 4/1949 | Biro |
| 2,564,721 | A | | 8/1951 | Raya |
| 2,610,884 | A | | 9/1952 | Enderle |
| 2,819,483 | A | | 4/1955 | Macaulay |
| 2,761,165 | A | | 9/1956 | Krzanowski et al. |
| 2,825,916 | A | | 3/1958 | Basala, Jr. |
| 2,856,622 | A | | 10/1958 | Jacobsen |
| 2,860,858 | A | | 11/1958 | Kurs et al. |
| 2,905,453 | A | | 9/1959 | Wise |
| D187,133 | S | | 2/1960 | Walters |
| 2,961,683 | A | | 11/1960 | Meyer et al. |
| 3,019,467 | A | | 2/1962 | Garrett |
| 3,170,182 | A | | 2/1965 | Barian et al. |
| 3,373,456 | A | | 3/1968 | Dalton et al. |
| 3,707,740 | A | | 1/1973 | Demers |
| 3,774,252 | A | | 11/1973 | Cantales et al. |
| 4,287,631 | A | | 9/1981 | Marrs |
| 4,324,018 | A | | 4/1982 | Olsson |
| D265,940 | S | | 8/1982 | Olsson |
| 4,517,699 | A | | 5/1985 | Petricka |
| 4,546,831 | A | | 10/1985 | Albertson |
| 4,606,777 | A | | 8/1986 | Brow |
| 4,667,361 | A | | 5/1987 | Wolcott et al. |
| D307,961 | S | * | 5/1990 | Howell ..... D32/35 |
| 4,953,906 | A | | 9/1990 | White |

(Continued)

*Primary Examiner* — Saeed T Chaudhry
(74) *Attorney, Agent, or Firm* — Morriss O'Bryant Compagni P.C.

(57) ABSTRACT

Disclosed herein is a roller cover cleaning apparatus. The apparatus may include a handle and a wire that is coupled to the handle. The wire may form a helix that extends around an axis of the helix for more than 360 degrees. The wire may be substantially radially equidistant from the axis of the helix along the length of the wire from the proximal end of the helix to the distal end of the helix. The wire may be at least partially resiliently flexible to increase the radial distance between the wire and the axis.

21 Claims, 5 Drawing Sheets

U.S. PATENT DOCUMENTS

| | | | |
|---|---|---|---|
| 4,982,471 | A | 1/1991 | Bannan |
| 5,020,181 | A | 6/1991 | Leonard |
| D330,101 | S | 10/1992 | Weiss |
| 5,272,782 | A | 12/1993 | Hutt |
| 5,335,392 | A | 8/1994 | Evans |
| D357,775 | S | 4/1995 | Panchuk |
| 5,452,734 | A | 9/1995 | Steeves |
| 5,515,567 | A | 5/1996 | Washburn |
| 5,539,948 | A | 7/1996 | McCauley et al. |
| 5,546,625 | A | 8/1996 | Mealey, Sr. |
| 5,661,865 | A | 9/1997 | Humphrey |
| 5,830,534 | A | 11/1998 | Dillon |
| 5,832,557 | A | 11/1998 | Hutchison |
| 6,125,497 | A | 10/2000 | Galbreath |
| 6,280,531 | B1 | 8/2001 | Galbreath |
| 6,284,318 | B1 | 9/2001 | Jackson |
| 6,530,109 | B1 | 3/2003 | Cassedy |
| 6,829,803 | B2 | 12/2004 | Hutchinsn |
| 6,954,964 | B2 | 10/2005 | Parkkonen |
| D511,600 | S | 11/2005 | Howe et al. |
| 7,774,890 | B1 | 8/2010 | Weiss, Jr. |
| 2002/0133967 | A1 | 9/2002 | Lonier |
| 2003/0126711 | A1 | 7/2003 | Korenevsky |
| 2003/0177597 | A1 | 9/2003 | Wallace, III et al. |
| 2005/0138750 | A1 | 6/2005 | Trincilla et al. |
| 2005/0150068 | A1 | 7/2005 | Parkkonen |
| 2005/0273964 | A1 | 12/2005 | Hobbs |
| 2006/0064836 | A1* | 3/2006 | Mowe ..... 15/236.03 |
| 2007/0124881 | A1 | 6/2007 | Daugherty |

* cited by examiner

ROLLER COVER CLEANER

CROSS-REFERENCE TO RELATED APPLICATION

This application claims the benefit of U.S. Provisional Patent Application No. 61/430,671, filed on Jan. 7, 2011, which is incorporated herein by reference.

FIELD

The invention relates to applicators for applying a flowable material to a surface, and more specifically to apparatus and methods for cleaning flowable material applicators.

BACKGROUND

Flowable material applicators are often used to apply a flowable material to a surface. One conventional type of applicator is a roller, which includes a roller frame, a roller rotatably coupled to the frame, and a roller cover co-rotatably secured to the roller. The roller cover is usually cylindrical and includes a fiber or fabric-like covering (e.g., a nap) for retaining the flowable material and transferring the material to a surface as the roller is rolled across the surface. The roller frame provides support for the roller cover, and often includes a handle. Some typical flowable materials include paint, adhesives, lacquers, stains, coatings, and the like. In the paint industry, a paint roller is an often-used applicator for applying paint to a surface. For example, during a painting operation, the roller cover is placed initially in the paint, and then rolled along a surface to transfer the paint from the roller cover to the surface.

Upon conclusion of a flowable material application (e.g., painting) operation or job, it may be desirable to clean the roller cover for future use. However, because the roller cover is typically saturated with the flowable material (e.g., paint), the roller cover can be difficult to clean. As a result, the roller cover is often thrown away after a single application operation or job. Continually disposing of used roller covers requires constant purchasing of new roller covers for new jobs, which can be expensive and inconvenient.

Some known paint roller cover cleaners are designed to clean paint from the roller covers for continual use of a single paint roller cover over multiple painting operations or jobs. However, such cleaners each have various design, application, and performance shortcomings. For example, some paint roller cover cleaners include a circumferential gap such that only a portion of the paint on the roller cover is removed, leaving behind a streak of un-removed paint. Other paint roller cover cleaners are difficult to position around the cover without threading a handle of the paint roller through the cleaner before or after the operation. Additionally, certain known cover cleaners are somewhat difficult to engage the cover without precisely aligning and applying a uniform pressure across the cleaner. Moreover, many known cover cleaners are prone to binding during the cleaning process, without a means to easily unbind the cleaners. Further, many known paint roller cleaners require the user to provide a source of substantially pressurized water from a specific faucet thread configuration to connect to a special hose or fitting supplied with the cleaner apparatus. If the user does not have the special thread or pressurized water available, the apparatus has limited use. Other cover cleaners require the user to furnish a power rotating tool (such as an electric drill) for rotary cleaning the cover.

SUMMARY

In one aspect, the subject matter of the present application provides a tool for cleaning a flowable material roller cover. The tool includes a handle and a wire coupled to the handle. The wire forms a helix that extends around an axis of the helix more than 360 degrees. The wire in the helix is substantially radially equidistant from the axis of the helix along a length of the wire from the proximal end of the helix to the distal end of the helix. The wire is also at least partially resiliently flexible to increase the radial distance between the wire and the axis.

In some implementations, a gap parallel to the axis of the helix is defined between rotations of the helix. The wire may further form a stem portion that couples the handle and the helix. In certain embodiments, the axis of the helix forms an acute angle with an axis of the handle that is between about 2-degrees and about 88-degrees. In one implementation, the acute angle is about 65 degrees.

In certain implementations, the roller cover cleaning apparatus includes a second helix that is coupled to an end of the handle opposing the end of the handle to which the first helix is coupled. The first helix may have an un-flexed internal diameter of a first size and the second helix may have an un-flexed internal diameter of a second size that is larger or smaller than the first size. In one implementation, the internal diameter of the first helix is between about 0.5 inches and about 3 inches.

In some implementations, the helix is configured such that in a flexed state it still extends around its axis at least 360 degrees within an entire elastic range of the helix or prior to reaching a yield strength of the helix. The wire may also include a user-engaging tab (such as an eyelet) at the distal end of the helix. The tab extends radially away from the axis of the helix for convenient access by a user if the helix becomes jammed on the roller cover while cleaning the cover.

In another aspect, the invention provides a method for cleaning a roller cover, which may be a paint roller cover. The method includes resiliently flexing a wire to form a helix about the roller cover, and passing (e.g., sliding) the helix down a length of the roller cover a first time. Generally, passing the helix down the length of the roller cover includes orienting the helix, such that an axis of the helix is maintained in substantial co-axial alignment with an axis of the cover. In certain embodiments, the method includes passing the helix down the length of the roller cover a plurality of times.

The method may also include cleaning the roller cover with a solvent, such as a cleaning fluid, water, and the like. Cleaning the roller cover with water involves immersing the roller cover in the solvent and, while the roller cover is immersed or after immersion of the roller cover, passing the helix down the length of the roller cover to remove from the cover additional flowable material and/or added solvent. These actions may be repeated until the solvent removed from the roller cover is substantially clear or free of flowable material, or until a desirable amount of flowable material has been removed from the cover. The method may also include spinning excess solvent out of the roller cover and fluffing up the nap of the roller cover.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, and from time to time, the same number is used to reference similar, but not necessarily identical, parts.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1A:
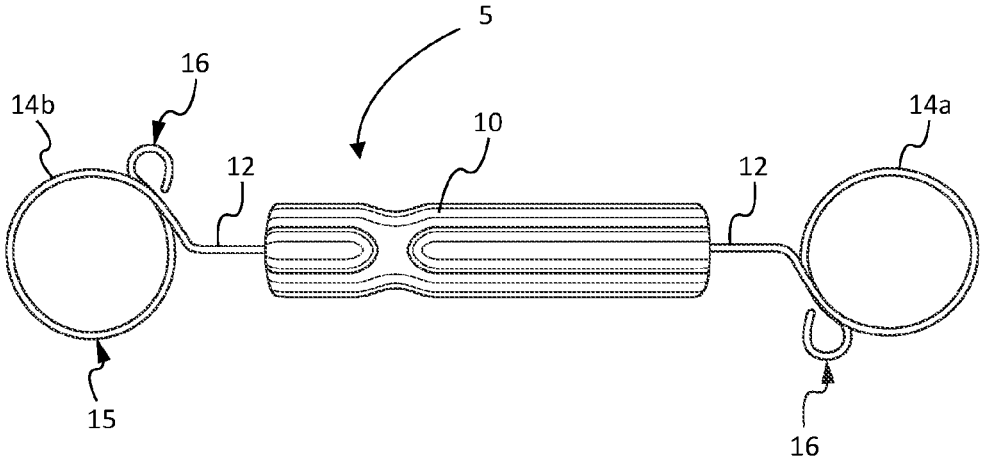
FIG. 1A is a top view of one embodiment of a roller cover cleaning apparatus.
Figure 1B:
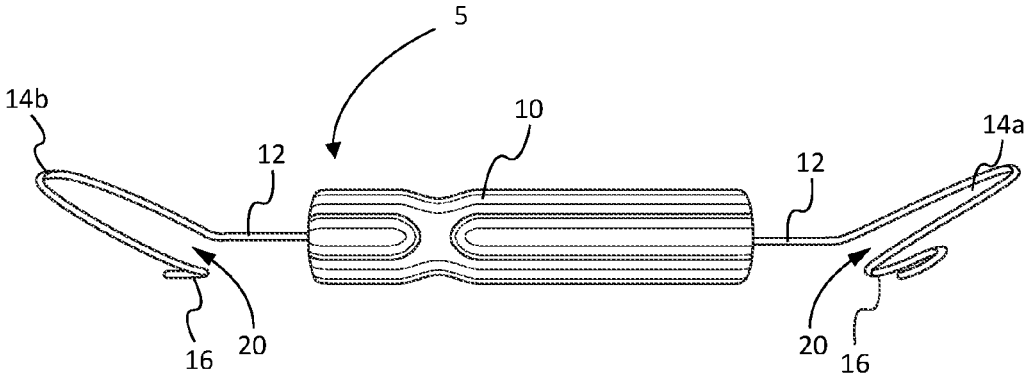
FIG. 1B is a side view of the roller cover cleaning apparatus of FIG. 1A.

According to one embodiment shown in FIGS. 1A and 1B, a roller cover cleaning apparatus 5 includes a handle 10, a first helix 14*a*, and a second helix 14*b*. The roller cover cleaning apparatus 5 also includes two stem portions 12 each coupling a respective one of the helices 14*a*, 14*b* to the handle 10. Each of the helices 14*a*, 14*b* includes a wire 15 shaped or formed into a helical or spiral configuration. In certain embodiments, the term helical is defined to mean a three-dimensional curve that lies on an imaginary cylinder such that the curve's angle to a plane perpendicular to a central axis of the helix is substantially constant. In other embodiments, the term helical is defined to mean a three-dimensional curve wound uniformly around an imaginary cylinder.

The wire 15 is defined to mean any wire-like or string-like cross section. Accordingly, the wire 15 need not be made from a metal, but can be made from any of various other materials, such as polymers, carbon fiber, glass, and the like. Further, the wire 15 need not have a circular cross-sectional shape, but can have any of various other varying or constant cross-sectional shapes, such as ovular, triangular, quadrangular, semi-circular, and the like. Similarly, the wire 15 can include ridges or other material removal enhancement features to aid in the removal of flowable materials from roller covers. Moreover, the wire 15 can have any of various cross-sectional shapes or diameters depending on the material type and desired flexibility and design of the helix. In some embodiments, the wire 15 is made from a material and has a cross-sectional shape and size conducive to providing a sufficiently resiliently flexible helical configuration with a desired yield strength as will be described in more detail below.

The wires 15 forming the helices 14*a*, 14*b* can be separate from each other or form part of the same wire. For example, in some embodiments, the helix 14*a*, helix 14*b*, and stems 12 all formed from a single wire 15. In such embodiments, the handle 10, which can be made from a plastic, metal, or other material type, may simply be formed around the portion of the single wire 15 that extends between the stems 12 such that the wire extends the entire length of the handle. Alternatively, in certain embodiments, the helices 14*a*, 14*b*, and the associated stems 12, are formed from separate and distinct wires. In such embodiments, each of the wires forming the helices 14*a*, 14*b* can be separately coupled to respective ends of the handle 10 such that the wires do not extend the entire length of the handle.

The handle 10 may be fixedly secured to the wire 15 to ensure that the handle 10 does not slip relative to the wire 15, and may include grip-enhancing features to promote gripping of the handle during use of the apparatus. The wire 15 may be mechanically coupled to the handle 10, chemically coupled to the handle 10 (such as with an adhesive), or coupled to the handle using other suitable approaches. The wire 15 may be made out of partially flexible metal, polymer, or other suitable material. Although the handle 10 shown in the illustrated embodiments is formed onto the wire or is separate from the wire forming the helices 14*a*, 14*b*, in some embodiments, the handle can simply be an extension of the wire(s) forming the helices. For example, an extension of the helices can include one or more switch-back portions to provide an adequate grip for a user.

As shown in FIG. 1A, the wire 15 forming the helix 14*a*, which is representative of helix 14*b*, extends around a central axis 30 (shown in FIG. 3) of the helix 14*a* for more than 360-degrees. Because the wire 15 forms a helix, the wire is radially equidistant from the axis 30 of the helix 14*a* at all points along the length of the wire 15 from a proximal end of the helix 14*a* to the distal end of the helix 14*a* to form a substantially constant diameter of the helix at any point along its axis 30. In one embodiment, the helix 14*a* has a constant un-flexed internal diameter of between about 0.5 and 5 inches. In certain implementations, the helix 14*a* has a constant un-flexed internal diameter of between about 1.5 inches and about 2 inches. Generally, the internal diameter of the helix 14*a* in an unflexed state is selected according to the size of the roller cover to be cleaned. Accordingly, the helix 14*a* can have any of various internal diameters other than those specifically listed herein.

The wire 15 may be at least partially resilient flexible to slightly increase the radial distance between the wire 15 and the axis of the helix 14*a* during use (e.g., to increase the constant internal diameter of the helix 15*a* when in a flexed state). For example, the wire 15 may be a hardened-tempered, stainless steel spring wire 15 with a specific resilient flexibility and yield strength. Such a material is an example of a material that is partially resiliently flexible to increase the radial distance between the wire 15 and the axis 30, but strong enough to sufficient resist permanent elastic deformation when flexed to clean a roller cover. Using a partially resiliently flexible material allows the wire 15 to expand when the helix 14*a* is placed over a roller cover and a downward directed force (e.g., a force in a direction coaxial with an axis of the roller cover) is applied to the apparatus. The downward directed force slides the helix 14*a* along the cover. As the helix 14*a* slides along the cover, the resilient nature of the helix 14*a* applies a radially inwardly directed pressure onto the surface of the roller cover, which acts to remove excess material from the roller cover more effectively. More specifically, the radially inwardly directed pressure on the surface of the cover allows the helix 14*a* to remove material from the cover along the entire length of the cover. The use of a partially resiliently flexible material, along with helices 14*a*, 14*b* with different internal diameters in an un-flexed state, allows the helix 14*a* to accommodate a range of sizes (e.g., nap lengths) of roller covers.

FIG. 1B shows more clearly the helical nature of the helix 14*a* and the helix 14*b*. FIG. 1B also shows that the helices 14*a*, 14*b*, by nature of being a helical shape, include respective gaps 20 or open spaces between the rotations of the helices. More particularly, due to the helical configuration of the helices 14*a*, 14*b*, a gap 20 exists between an initial rotation of the helices 14*a*, 14*b* and the respective stems 12. As seen in FIG. 1B, the gaps 20 are defined as spaces between the respective helices 14*a*, 14*b* that extend parallel to the axes 30 of the respective helices. In certain embodiments, the gaps 20 are substantially uniform or constant along the axes 30 the helices when in a particular state (e.g., flexed or un-flexed). In other embodiments, the size of the gaps 20 varies along the axes of the helices 14*a*, 14*b*. Nevertheless, in preferred embodiments, the helices 14*a*, 14*b* are configured such that a gap 20 of a predetermined length exists between a rotation of the helices 14*a*, 14*b*. As discussed in more detail below, this gap 20 allows the cleaning apparatus to be passed through the wire portion 22 of the frame 25 of a roller proximate the end 28 of the roller cover 27 closest the frame 25 (see, e.g., FIGS. 4A and 4B). In this manner, the handle of the roller and frame need not be passed through the apparatus 5 in order to be positioned to clean the roller cover (see, e.g., FIG. 4A).

In certain embodiments, the first and second helices 14*a*, 14*b* are right-handed helices. In other embodiments, the first and second helices 14*a*, 14*b* are left-handed helices. Alternatively, in some embodiments, the first helix 14*a* can be one of a right-handed and left-handed helix, and the second helix 14*b* can be the other of the right-handed and left-handed helix.

Figure 2:
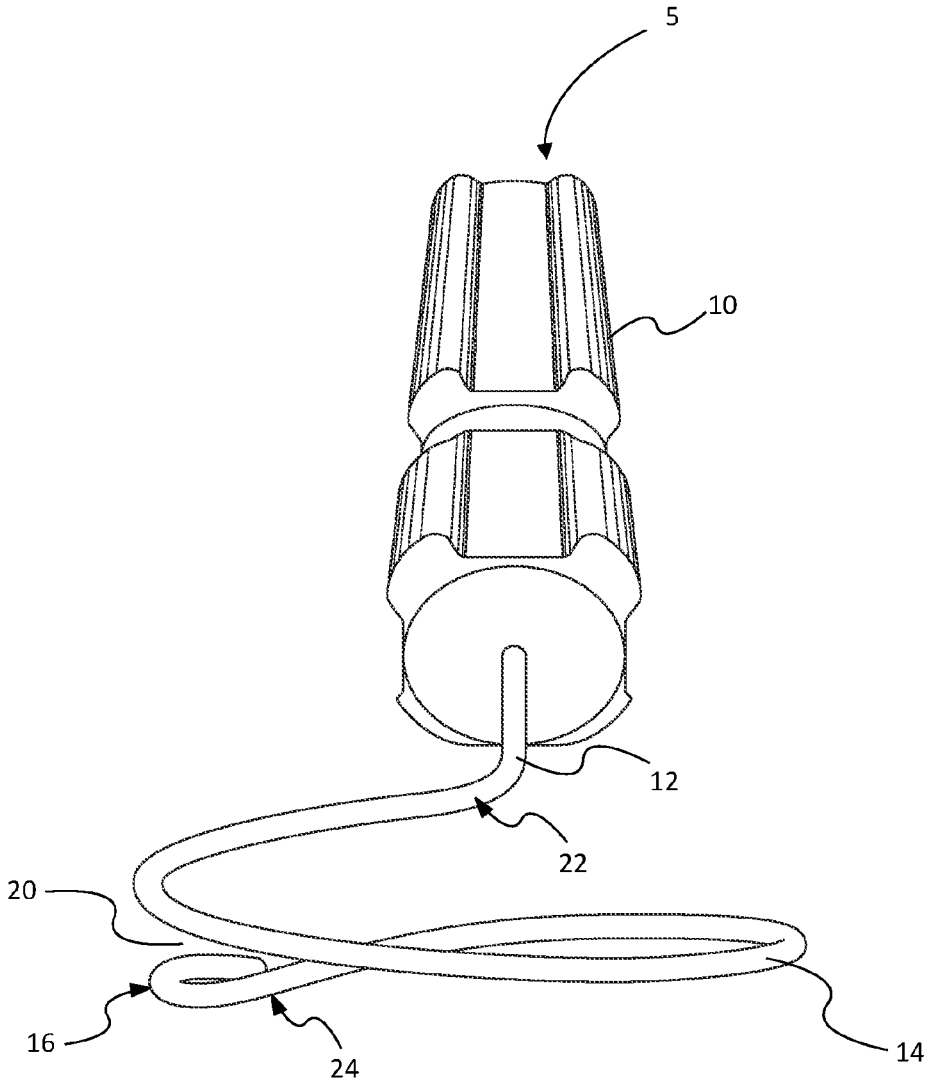
FIG. 2 is a front view of one embodiment of a roller cover cleaning apparatus.

FIG. 2 shows one embodiment of a roller cover cleaning apparatus 7 with a single helix 14, which is representative of each of the helices 14*a*, 14*b* of the apparatus 5 described above. As shown, the helix 14 includes a proximal end 22 and a distal end 24. In one embodiment, in an un-flexed state, the total rotation of the helix 14 from the proximal end 22 to the distal end 24 is greater than about 360-degrees such that at least some portion of the helix overlaps the proximal end 22. In some implementations, the total rotation of the helix 14 in an un-flexed state is between about 350-degrees and about 450-degrees. In one specific implementation, the total rotation of the helix 14 in an un-flexed state is approximately 400-degrees.

As discussed above, the resiliently flexible or elastic properties of the helix 14 allow the helix to be openly flexed to increase the radial dimensions (e.g., diameter) of the helix 14 when the helix 14 encounters the nap containing a flowable material, yet still maintain a pressure on the nap that forces flowable material out of the nap, and then un-flex to return to an original un-flexed state after completing the pass down the length of the roller cover. More specifically, as long as the stress (e.g., radially outward directed pressured associated with engaging the helix with a roller cover) on the helix 14 is less than a yield strength of the helix (i.e., the deformation of the helix remains within an elastic deformation range), the helix will return to its original un-flexed configuration. If the stress exceeds the yield strength of the helix 14 or the deformation of the helix exceeds the elastic deformation range, then irreversible plastic deformation occurs and the helix will not return to its original un-flexed state.

Generally, then, the helix 14 is configured with a size, shape, and material that allows the helix to open to engage the roller cover and apply a radially inwardly directed sliding pressure on a roller cover to facilitate cleaning, but also allows the helix to return to an original configuration for continued operational use. Accordingly, the material from which the helix 14 is formed, and the number of degrees of rotation of the helix, may be correlated such that the helix 14 extends around the axis at least 360 degrees in a flexed state associated with a stress less than the yield strength of the helix material (i.e., an elastic deformation within the elastic range of the helix 14). As a result, in certain implementations, when the helix 14 is at the end of the elastic range (i.e., the helix 14 is being deformed outwardly to the maximum possible extent before plastic deformation occurs), the helix 14 still provides at least 360 degrees of coverage of the roller cover that is within the helix 14. Further, because the helix 14 remains a magnitude of rotation greater than 360-degrees even in a flexed state, when using the helix to clean a roller cover, a full 360-degrees of the roller cover is in contact with the helix to remove 360-degrees worth of material from the cover. In this manner, the cleaning apparatus 5 do not leave a streak of unremoved paint at each pass because the helix 14 covers the entire circumference of the roller cover when engaged with the cover. As mentioned above, the magnitude of rotation for the helix 14 may be correlated to the material chosen. For example, the degree of rotation of a helix may be more for a more elastic or flexible material compared to a less elastic or flexible material.

In certain embodiments, the material forming the helix 14 may include features to aid in removing flowable material from the roller cover. For example, in one embodiment, the wire 15 may provide ridges, rather than the rounded edges shown in FIG. 2. The ridges may allow the wire 15 to remove more flowable material when the helix 14 is moved down the roller cover. Other suitable features may also be used.

The helix 14 includes a tab 16 positioned proximate the distal end 24. Generally, the tab 16 extends radially away from the axis 30 of the helix 14 at the distal end 24. As shown, the tab 16 is an eyelet formed by bending the wire 15 into an eyelet shape. In other embodiments, such as those embodiments in which the wire 15 is made from a plastic, the tab 16 may be a fin or protrusion capable of being engaged by a user to expand or open the helix 14. In certain circumstances, when cleaning a roller cover, a user may mistakenly use a helix 14 with an undersized internal diameter given the external diameter of the roller cover, causing the helix 14 to become stuck on the roller cover. If the helix 14 becomes stuck on the roller cover, the user may engage the tab 16 and move it radially outwardly away from the axis 30, or move it tangentially to the helix 14 in the direction as to uncoil the helix 14. The user may also use a combination of these two approaches. The actions increase the diameter of the helix 14 and lessen the inward radial pressure on the cover being cleaned. The increase in the diameter of the helix 14 allows the user to pass the helix 14 along the cover more easily. In other certain circumstances, when cleaning a roller cover, the axis 30 of the helix 14 may become misaligned with an axis of the cover, which can cause the roller cover cleaning apparatus to bind against the cover, If binding occurs, the user may axially realign the helix 14 and the cover at anytime by repositioning the handle 10 accordingly. The tab 16 extends radially outward from the wire helix 14 and is oriented to be generally perpendicular to the axis of the helix 14. A purpose of this outwardly extending tab 16 is so that the blunt end of the wire 15 will not bear excessively on the roller cover being stripped and cleaned. The tab 16 also provides the user with a grip to open the wire helix if necessary. The tab 16 further provides an abutment to prevent the end of the wire 15 from jumping the wire portion of the helix 14 above the tab, that is to have the lower portion of the helix 14 move above the upper portion (the portion closer to the handle) of the helix 14 which could otherwise occur during use while removing paint from a paint roller cover as the helix 14 is forced along the roller cover.

Figure 3:
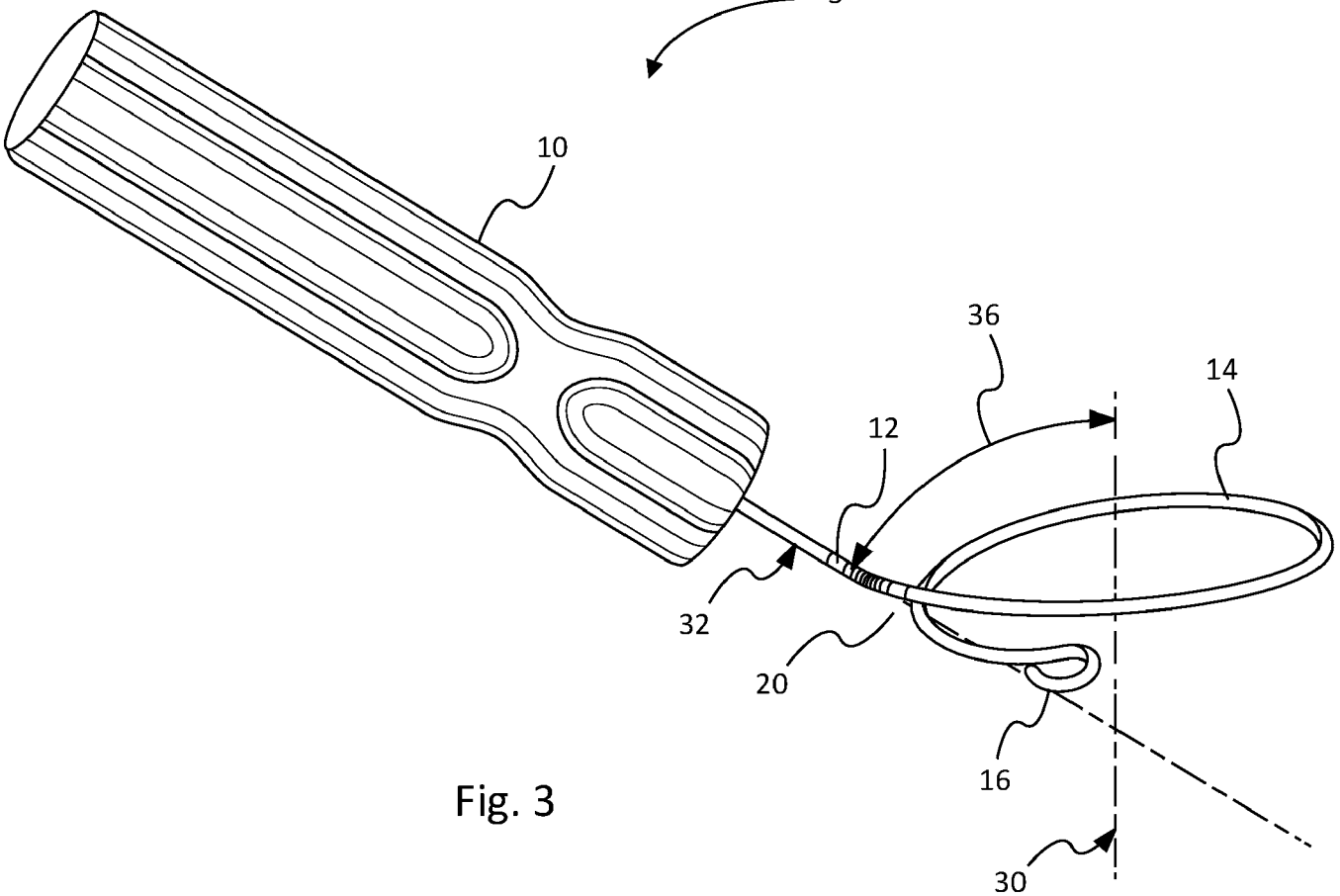
FIG. 3 is a side view of one embodiment of a roller cover cleaning apparatus.

As shown in FIG. 3, the helix 14 is angled (e.g., formed) with respect to the stem 12 or handle 10. More specifically, the axis 30 of the helix 14 and an axis 32 of the handle 10 define an acute angle 36 that is between 0-degrees and 90-degrees. In certain implementations, the acute angle 36 is between about 10-degrees and about 70-degrees. In certain implementations, the acute angle 36 is between about 30-degrees and about 50-degrees. In one specific implementation, the acute angle 36 is about 65-degrees. Angling the helix 14 with respect to the handle 10 by an acute angle 36 allows a user to more easily use the roller cover cleaning apparatus 7 and reduce the possibility of accidentally getting flowable material on the user's hands when cleaning the roller cover. The acute angle 36 may also promote a more comfortable or efficient orientation of the apparatus 7 relative to the roller cover, which may lead to better leverage in passing the helix 14 down the roller cover.

Figure 4A:
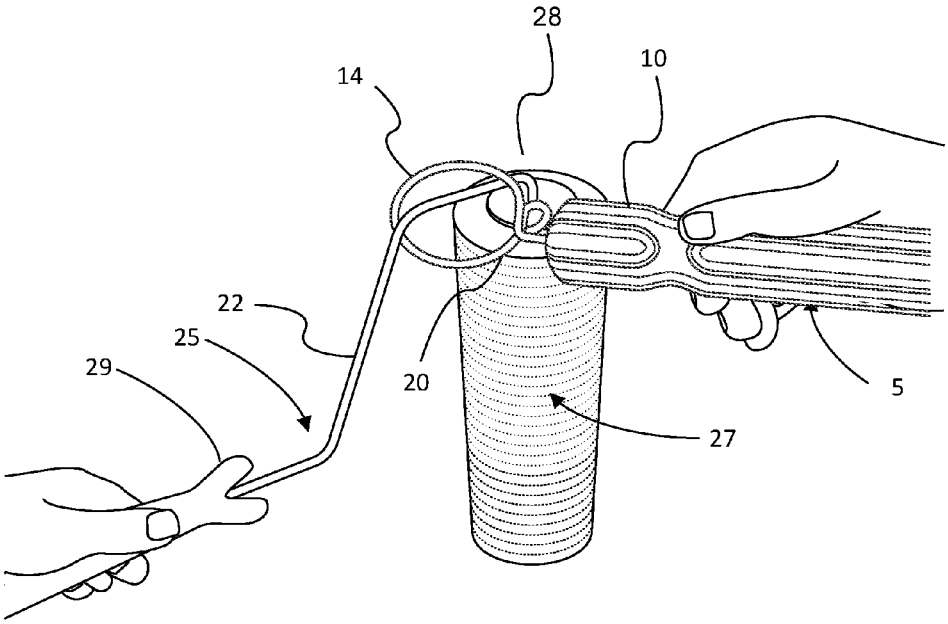
FIGS. 4A and 4B are perspective views of a roller cover cleaning apparatus engaging a roller cover.
Figure 4B:
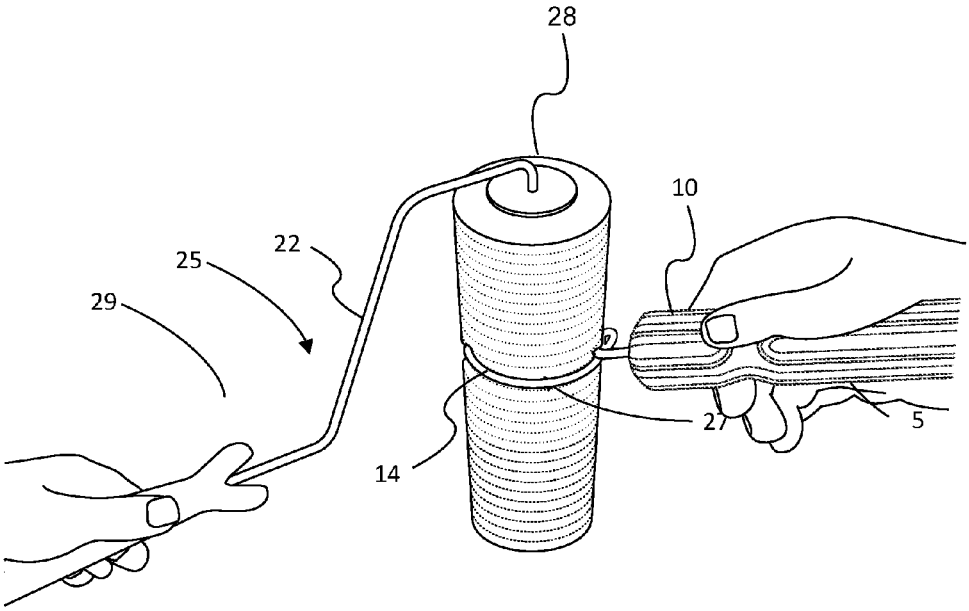

As shown in FIGS. 4A and 4B, the gap 20 is sufficiently large to allow the wire portion 23 of a roller frame 25 to pass through the gap 20. In one implementation, the gap 20 is approximately 0.5 inches. In other implementations, the gap 20 is more or less than 0.5 inches. The user may pass the helix 14 over the wire portion of the roller frame 25 and position the helix 14 above a roller cover 27 of the frame as seen in FIG. 4A. In other embodiments, although less preferred, the user may pass the handle 29 of the roller frame 25 through the helix 14 and position the helix 14 above the roller cover 27. To clean a paint roller cover, the user holds the paint roller frame handle in one hand with the frame arm upward. The user then holds the handle 10 (see FIG. 1) in the other hand. The user rests the stem 12 (see FIG. 1) on top of the roller frame arm. The tab 16 (see FIG.1) is positioned below the frame arm. The user then draws the handle 10 toward the user hooking the helix 14 around the paint roller frame. The user then positions the helix 14 downward onto the top end of the roller cover 27.

The user may then pass the helix 14 down over the roller cover 27 as seen in FIG. 4B. As the helix 14 passes along the roller cover 27, flowable material on the roller cover 27 is deflected away and removed from the cover. As discussed above, the helix 14 can be configured to tightly fit over the roller cover 27 in order to ensure that the flowable material or paint is removed efficiently as the helix 14 is moved down the roller cover. In one embodiment, a helix with an un-flexed internal diameter of approximately 1.8 inches is used for roller covers with a nap of about 0.5 inches or less, and for some 0.75 inch naps. The roller cover cleaning apparatus may also have a second helix 14 (as shown in FIG. 1) that has a different internal diameter, which allows the roller cover cleaning apparatus to be used over a wider range of roller cover and/or nap sizes.

Although not shown, in certain embodiments, the handle 10 includes an attachment for a hose. The handle 10 may define a channel that carries a solvent (e.g., water) from the hose to the roller cover 27. Such an embodiment may make applying solvent to the roller cover 27 easier when cleaning the roller cover.

Figure 5:
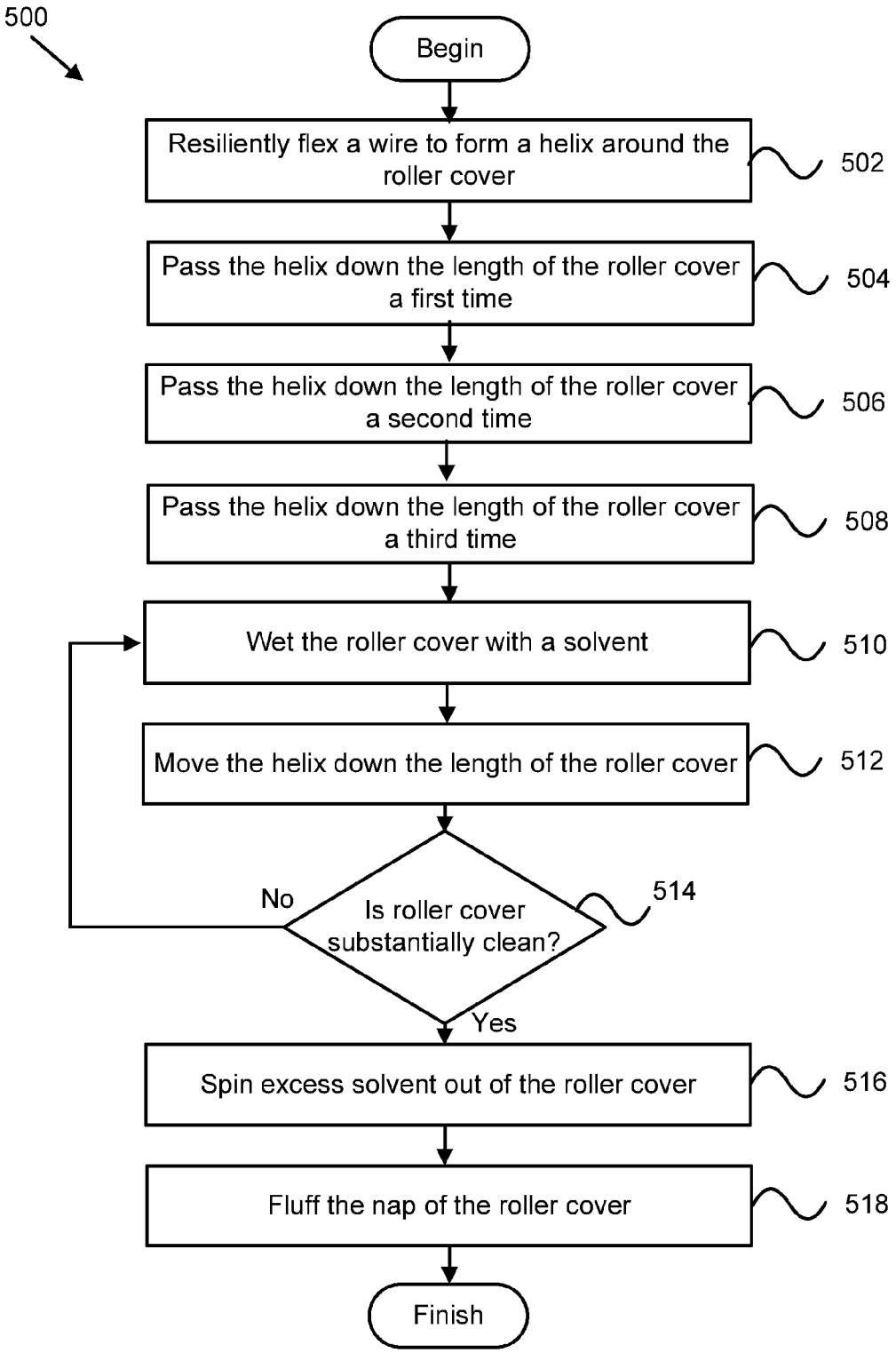
FIG. 5 is a flow chart diagram of one embodiment of a method for cleaning a roller cover.

FIG. 5 shows one embodiment of a method 500 for cleaning a roller cover. The method 500 begins with resiliently flexing 502 a wire 15 to form a helix 14 around the roller cover. The user may do so by positioning the helix 14 proximate a fixed end 28 (see, e.g., FIG. 4B) of the cover 27 and maneuvering the helix such that the fixed end extends through the helix. The method 500 also includes passing or moving 504 the helix 14 down the length of the roller cover a first time while maintaining the axis 30 of the helix 14 substantially aligned with the axis of the cover. As the helix passes along the cover, flowable material on the cover is forced out and away from the cover. Ideally, a container or other receptacle is positioned below the cover to capture the material as it is removed from the cover. The container could be a paint roller tray.

The method 500 further includes moving 506 the helix 14 down the length of the roller cover a second time, and moving 508 the helix 14 down the length of the roller cover a third time. These repeated passes may remove the majority of the flowable material from the roller cover. Additional passes in this manner may be utilized if desirable.

Following the first (e.g., initial) pass or passes along the length of the cover, the method 500 includes wetting 510 the roller cover in a solvent, such as water or another suitable solvent. The user may, for example, submerge the roller cover in a container of water, place the roller cover under a flow of water, or use other approaches to wetting the roller cover. The user may again move 512 the helix 14 down the length of the wetted roller cover. The method 500 may involve determining 514 whether the water expelled from the roller cover is substantially clear or clean, which is directly related to whether the roller cover is substantially clean or cleaned to a desirable level. If the water is not substantially clear clean (i.e., the roller cover is not substantially clean) the method 500 may involve repeating the steps of wetting 510 the roller cover and moving 512 the helix 14 down the length of the roller cover until the water is substantially clear or the roller cover is substantially clean.

Once the water is substantially clear, or the roller cover is clean enough, the method 500 may include spinning 516 the excess water out of the roller cover and fluffing 518 the nap of the roller cover. Additionally, the method can include setting the roller cover aside to dry. Additionally, if desirable, prior to (or after) spinning the excess solvent out of the roller cover, the method 500 can include removing the cover from the frame, reversing the cover's orientation relative to the frame, and reinstalling the cover on the frame in a reversed configuration. Then, the step of passing the helix down the length of the roller cover can be repeated one or more times, with or without additional solvent, to remove additional excess paint and solvent from the cover.

In certain embodiments, a solvent other than water is used to aid in cleaning the roller cover. For example, the solvent may be acetone, turpentine, methyl ethyl ketone, or other suitable solvent depending on the flowable material to be removed. The steps described above may be applied using another solvent other than water. In certain embodiments, a combination of solvents may be used. For example, a number of passes may be made using turpentine as the solvent, followed by a number of passes using paint thinner as the solvent.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an", is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A paint roller cover cleaning apparatus, comprising:

a handle having proximal end and a distal end;

a wire coupled to the handle, the wire forming a helix that extends around an axis of the helix more than 360-degrees, wherein a gap circumferentially extends relative to the helix is defined between rotations of the helix between a proximal end portion of the helix and a distal end portion of the helix, a distance between rotations of the helix being sufficient to allow passage of a frame of a paint roller, and wherein the wire is substantially radially equidistant from the axis of the helix along a length of the wire from the proximal end of the helix to the distal end of the helix, the wire being at least partially resiliently flexible to allow an increase in the radial distance between the wire of the helix and the axis, the radial distance being slightly larger than a radius of a paint roller cover so that the helix tightly fits around the paint roller cover; and a tab formed at the distal end of the helix, the tab extending radially away from the axis of the helix and having a width sufficient to prevent the distal end of the helix from jumping another portion of the helix during use.

2. The cleaning apparatus of claim 1, wherein the wire further forms a stem portion coupling the handle and the helix.

3. The cleaning apparatus of claim 2, wherein the stem portion has a length that is less than a diameter of the helix.

4. The cleaning apparatus of claim 1, further comprising a second helix coupled to a second end of the handle by a second stem portion.

5. The cleaning apparatus of claim 1, wherein the helix extends around the axis at least 360 degrees within an elastic range of the helix.

6. The cleaning apparatus of claim 1, wherein the wire further comprises a user-engaging tab extending radially away from the axis of the helix at the distal end of the helix.

7. The cleaning apparatus of claim 6, wherein the user-engaging tab is an eyelet formed from the wire.

8. The cleaning apparatus of claim 1, wherein the helix has an internal diameter between 0.5 inches and 5 inches in an un-flexed state.

9. The cleaning apparatus of claim 1, wherein the axis of the helix is oriented at an acute angle relative to a longitudinal axis of the handle to upwardly angle the handle relative to the helix.

10. The cleaning apparatus of claim 9, wherein the wire forming the helix extends around an axis of the helix to position the tab proximate the handle.

11. The cleaning apparatus of claim 1, wherein the wire forming the helix extends less than about 450 degrees around an axis of the helix.

12. The cleaning apparatus of claim 1, wherein the axis of the helix is at an acute angle greater than 30 degrees relative to a long axis of the handle.

13. The cleaning apparatus of claim 12, wherein the acute angle is approximately 65 degrees.

14. An apparatus for cleaning a paint roller cover, comprising:

an elongate handle configured for grasping by a user having a distal end, a proximal end and a long axis;

a helical structure coupled to and extending from the distal end of the handle, the helical structure defining a helix that extends around an axis of the helix more than 360-degrees and less than about 450-degrees, and defining a gap that circumferentially extends relative to the helix between rotations of the helix between a proximal end portion of the helix and a distal end portion of the helix, a distance between rotations of the helix being sufficient to allow passage of a frame of a paint roller, the helical structure being at least partially resiliently flexible to allow an increase in the radial distance between the helical structure and the axis, the radial distance being slightly larger than a radius of a paint roller cover so that the helix tightly fits around the paint roller cover, the axis of the helix being at an acute angle greater than 30 degrees relative to the long axis of the handle.

15. The apparatus of dam 14, further comprising a tab at the distal end of the helix and extending away from the axis of the helix.

16. The apparatus of claim 15, wherein said tab comprises an eyelet formed at the distal end of the helix from a loop of the wire, the eyelet lying in a plane that extends radially away from the axis of the helix.

17. The apparatus of dam 15, wherein the tab radially extends relative to the axis of the helix a sufficient distance to prevent the distal end of the helix from jumping a portion of the helix above the tab during use.

18. The apparatus of claim 15, wherein the tab is positioned relative to the handle to provide a grip to expand the diameter of the helix by moving the tab in a substantially tangential direction relative to the helix.

19. The apparatus of claim 14, wherein the helix extends around an axis of the helix approximately 400 degrees.

20. The apparatus of claim 14, wherein the acute angle is approximately 65 degrees.

21. The cleaning apparatus of dam 14, further comprising a stem portion coupling the handle to the helical structure and providing a rest for resting on the frame of the roller cover in order to draw the handle to hook the helical structural around the frame of the paint roller cover.

* * * * *